United States Patent [19]

Jensen

[11] Patent Number: 4,571,888

[45] Date of Patent: Feb. 25, 1986

[54] VENT WINDOW LATCH

[75] Inventor: Kirk S. Jensen, Allen Park, Mich.

[73] Assignee: Irvin Industries Inc., Rochester Hills, Mich.

[21] Appl. No.: 619,485

[22] Filed: Jun. 11, 1984

[51] Int. Cl.[4] ..... E05C 17/62
[52] U.S. Cl. ..... 49/450; 49/374
[58] Field of Search ..... 49/450, 428, 374

[56] References Cited

U.S. PATENT DOCUMENTS

| | | | |
|---|---|---|---|
| 1,672,369 | 6/1928 | Chaffee | 49/450 X |
| 3,264,032 | 8/1966 | Smith | 49/450 X |
| 4,171,835 | 10/1979 | Conley et al. | 49/450 X |
| 4,502,248 | 3/1985 | Thomas, Jr. et al. | 49/450 X |

*Primary Examiner*—Kenneth Downey

[57] ABSTRACT

Manually operable vent window latch for passenger cars having vertical guide tracks with ratchet retention track including lost motion resiliently biased latch to assure top seal retention in raised latched position.

10 Claims, 7 Drawing Figures

FIG. 1
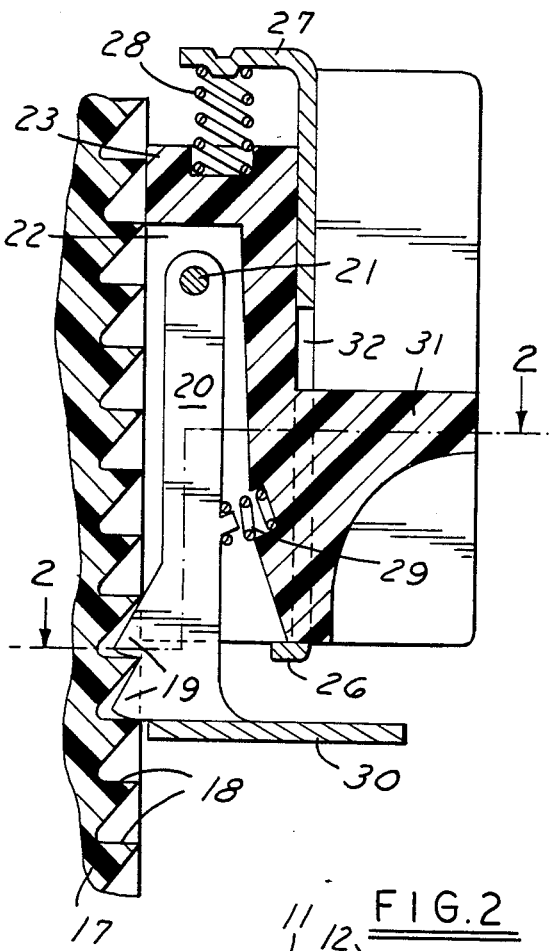
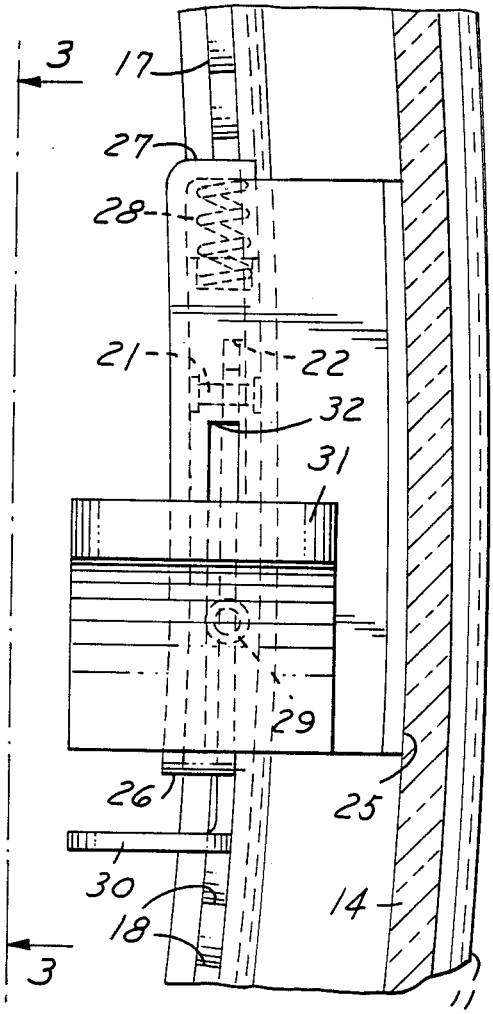
FIG. 3
FIG. 2
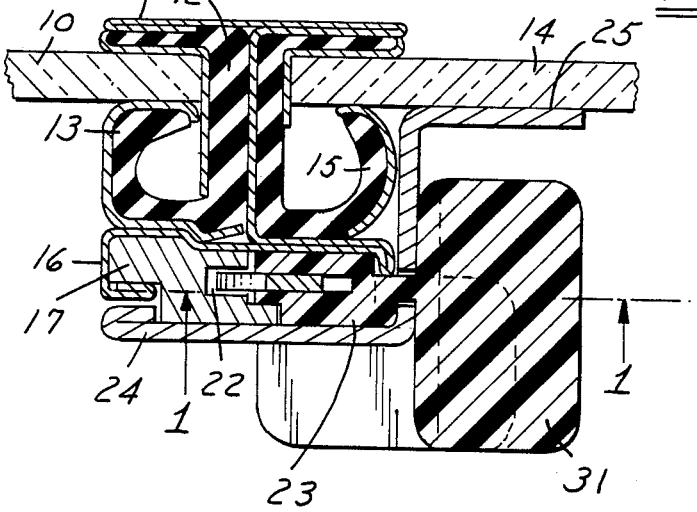

38
39
36
37
44
56
53
55
48
54
47
35
37

58
42
57
56
43
44
35
55
54

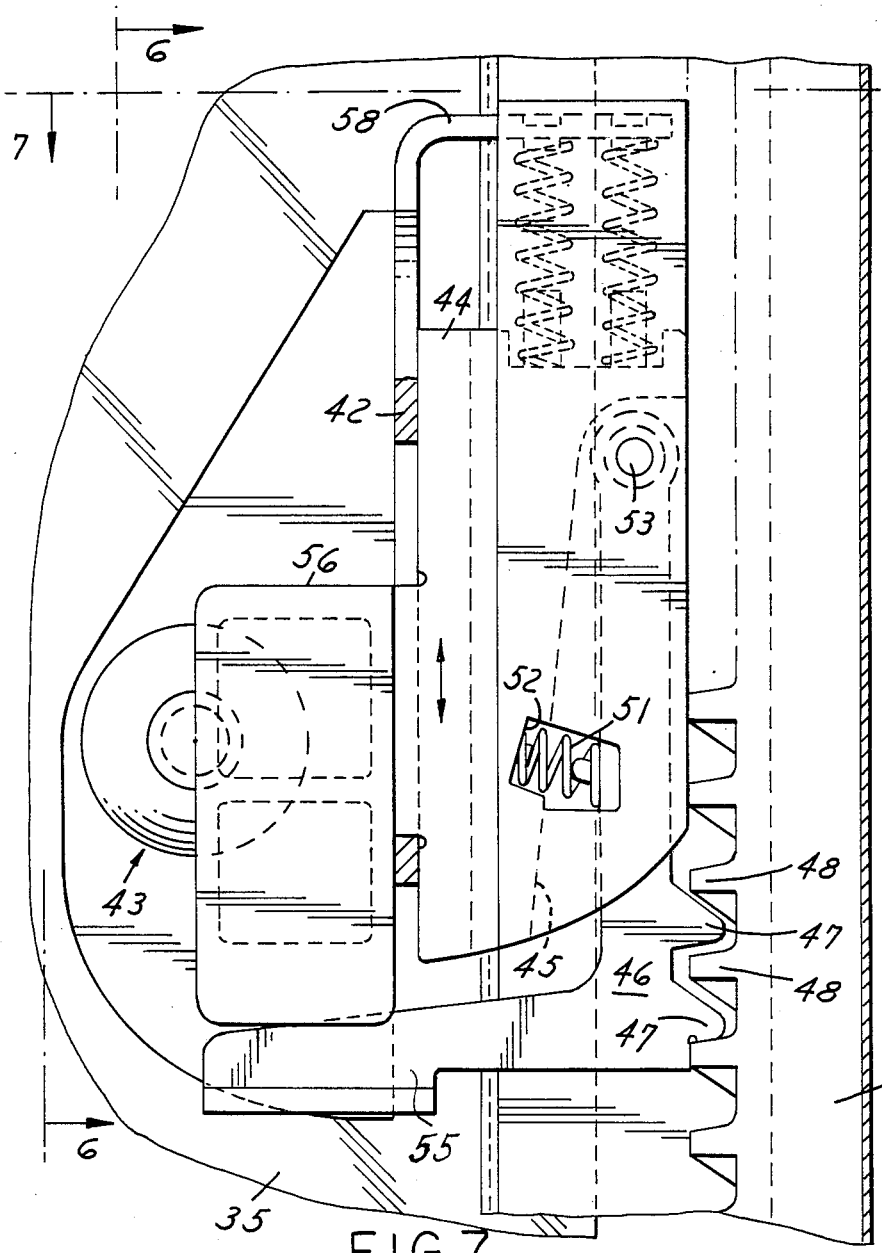
FIG. 5
FIG. 7
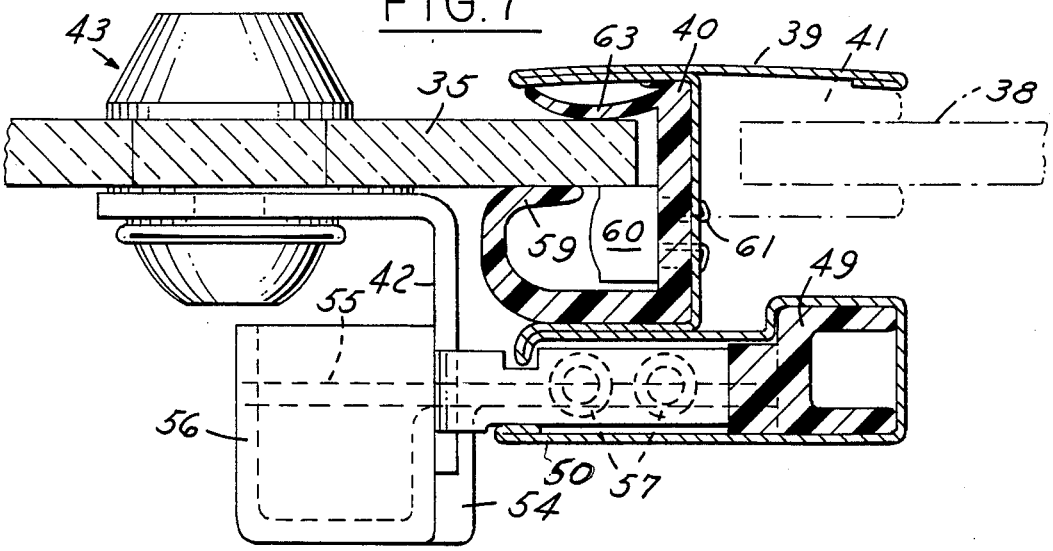

VENT WINDOW LATCH

BACKGROUND OF THE INVENTION

Vent windows pivotally mounted for opening to an angular relation with the main side window plane are well known in the trade as "Fisher no draft" vents.

Power windows having vent elements operating in the same vertical plane as the main window which are first to open and last to close under the operation of power window regulators are also known in the art, as a more recent alternative to the pivoted vent, to provide a relatively small opening for air circulation, venting of cigarette smoke and the like.

Similar manually operable vents vertically slidable in the plane of the main side window having a latch for engaging ratchet teeth to retain the vent window in a raised or adjusted open position have been contemplated which are subject to certain operating deficiencies, particularly in the raised closed position, due to the possibility of the vent window with its latch dropping slightly in reaching a seated position against the ratchet teeth effective to retain the vent window from lowering. Thus, where the fully raised position of the vent window did not exactly match the seated latch position against the ratchet teeth gravity operating on vent window under normal road vibration could cause the vent window to creep downwardly in reaching full latch engagement resulting in air leakage and wind whistle at the top seal.

SUMMARY OF THE INVENTION

Applicant has found that by resilient loading of the latch relative to the vent window track with sufficient lost motion to accommodate the pitch of the ratchet teeth, it is possible to move the vent glass to a raised sealing position with sufficient pressure to compress the resilient means in seating the latch so as to retain the sealing relation of the upper glass edge under resilient compression notwithstanding a slight drop in the latch teeth per se in finding a seated engagement with the ratchet teeth of the track.

BRIEF DESCRIPTION OF THE DRAWINGS

FIG. 1 is a fragmentary vertical sectional view of the latch assembly taken along the line 1—1 of FIG. 2;

FIG. 2 is a sectional view taken along the line 2—2 of FIG. 1;

FIG. 3 is a view taken along the line 3—3 of FIG. 1;

FIG. 5 is an enlarged fragmentary view of the latch assembly per se illustrated in FIG. 4;

FIG. 7 is a view taken along the line 7—7 of FIG. 5.

DETAILED DESCRIPTION OF THE PREFERRED EMBODIMENT

Figures 4, 6:
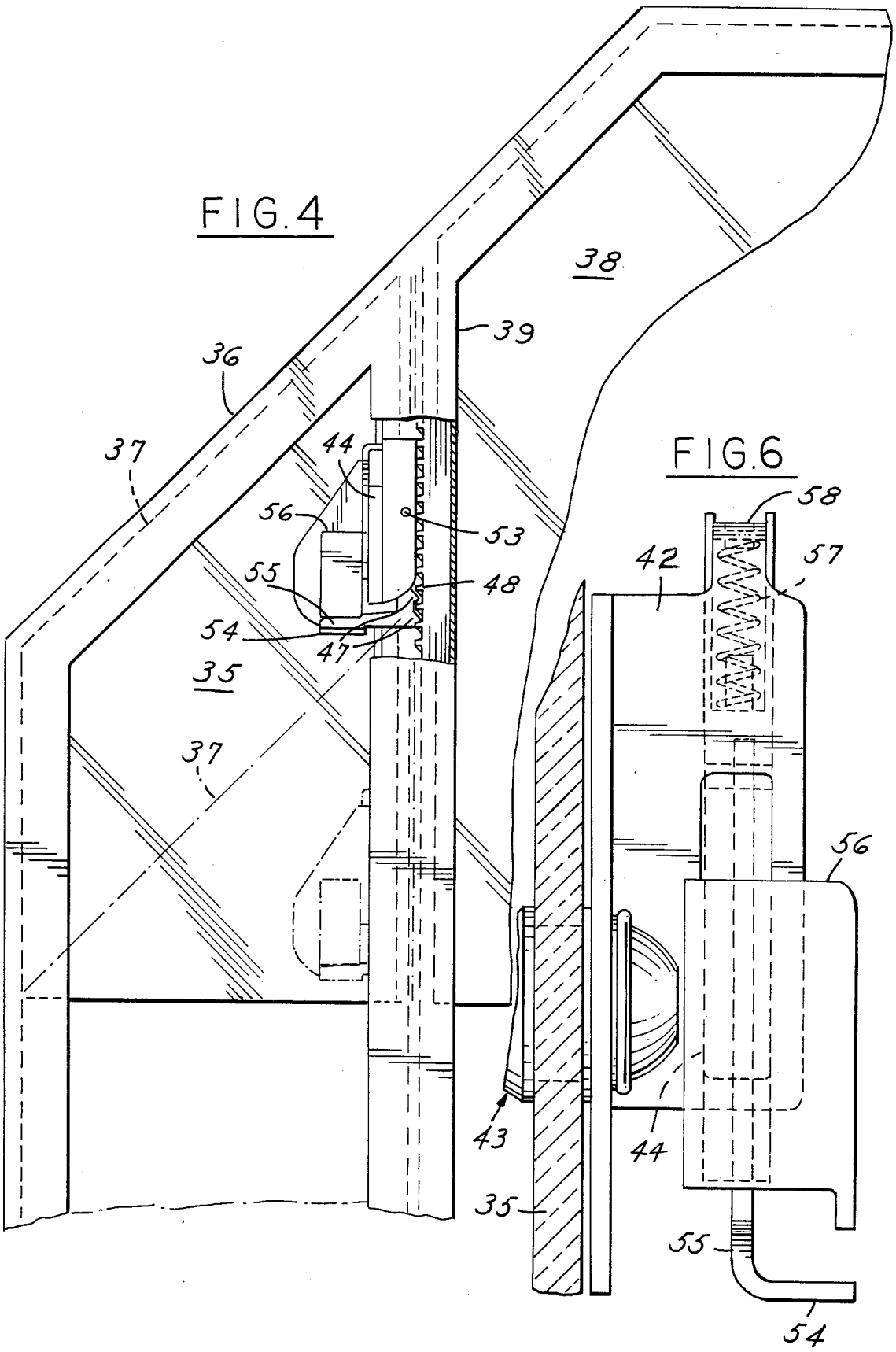
FIG. 4 is a fragmentary side elevation of a modified embodiment.
FIG. 6 is a view taken along the line 6—6 of FIG. 5.

With reference to FIG. 2 the main window glass 10 slides within a fixed vertical channel 11 roll formed to enclose a resilient rubber cushion element 12 having a lip extension 13 to establish a compression seal against the window. Vent glass 14 is adapted similarly to slide within channel 11, in alignment with and independently of the main window glass 10, held in sealing relationship by resilient extension 15. Channel track 11 is further roll formed within an inner channel section 16 for housing a vertical ratchet rack strip 17 having ratchet teeth 18 engageable by mating latch teeth 19 of latch arm 20 pivotally connected at 21 within a slot 22 formed in slide 23 secured within channel 24, bonded at 25 to vent glass 14. Slide 23 is vertically movable within channel 24 within limits established by lower flange 26 and upper flange 27 and is urged by compression spring 28 to its lowermost position as shown in FIG. 1.

Latch lever 20 is urged by spring 29 seated in slide 23 to a latch engaging position as shown and is provided with a lower thumb pad 30 for effecting latch disengagement and raising the vent glass to an upwardly adjusted or closed position. Finger projection 31 of slide 23 extending through lost motion slot 32 in channel 24 serves to effect manual lowering of vent glass 14 while thumb pressure on lever 20 holds the latch in disengaged position.

It will be understood that upon raising vent glass 14 to its uppermost sealing position, spring 28 may be compressed by slide 23 to an extent at least equal to the pitch of one tooth 18 which may be fully engaged while spring 28 remains under compression to retain the vent glass in its uppermost sealing position.

With reference to the preferred embodiment of FIGS. 4–7 vent glass 35 is shown in raised position relative to main window frame 36 with upper edge 37 illustrated in phantom in lowered position. Vent glass 35 together with main glass 38, shown in raised position, engage vertical channel track 39 within which resilient seals 40 and 41 are housed for guiding and sealing adjacent glass edges.

Angle bracket 42 secured to vent glass 35 by screw fastener 43 provides a housing for vertical slide 44 slotted at 45 to receive latch arm 46 having latch teeth 47 for engaging ratchet teeth 48 of ratchet rack 49 secured within channel extension 50 of vertical channel track 39. Spring 51 seated in pocket 52 in slide 44 urges latch arm 46 pivotally mounted at 53 on slide 44 into latch engagement releasable by thumb flange 54 projecting from latch arm extension 55. Finger engageable projection 56 of slide 44 together with thumb flange 54 permit the vent glass to be adjusted to any desired position and, upon raising to uppermost position, a pair of compression springs 57 reacting against flange 58 of channel 42 accommodate slide compression to assure latch engagement with the vent glass in uppermost sealing position.

It will be noted that resilient seal 40 for vent glass 35 is provided with sealing lip 59 and separate guide strip 60 riveted at 61 to vertical web 62 of channel track 39 which, together with relatively flexible seal extension 63, serve to facilitate relatively free adjustment of vent glass position.

I claim:

1. Manually operable vent window for automotive vehicle comprising, window frame means including vertical guide tracks and top edge seal, vent window glass slidable in said vertical guide tracks, fixed ratchet rack means extending along one of said vertical guide tracks, bracket means secured to said vent window glass for imparting vertical adjustment, manual means for moving said bracket means including vertically resilient lost motion connection means, and latch means connected to said manual means for engaging said ratchet means in any adjusted position of said vent window glass, whereby said manual means may raise said vent glass to its uppermost position engaging said top edge seal and impart an upward resilient bias to retain said vent glass in said top edge seal engaging position upon latch engagement with said ratchet means.

2. Vent window of claim 1 wherein said manual means comprises a slide vertically movable within end limits on said bracket means.

3. Vent window of claim 2 wherein compression spring means are included in said vertically resilient lost motion connection means.

4. Vent window of claim 3 wherein said latch means comprises a latch lever pivotally connected to said manual means.

5. Vent window of claim 4 including resilient means biasing said pivoted latch lever toward a ratchet engaging position.

6. Vent window of claim 5 including thumb engageable extension means on said latch lever for effecting latch release.

7. Vent window of claim 6 including finger engageable extension means on said manual means for effecting simultaneous thumb release and finger engagement to lower said vent window to an adjusted open position.

8. Vent window of claim 1 wherein said one vertical track comprises a dual track for aligned main and vent windows.

9. Vent window of claim 8 wherein said dual track is formed to house said fixed ratchet rack means and to provide a guide track for said manual means.

10. Vent window of claim 1 wherein said manual means includes a slot for pivotal mounting of said latch lever.

* * * * *